US008116662B2

(12) United States Patent
Ohta

(10) Patent No.: US 8,116,662 B2
(45) Date of Patent: Feb. 14, 2012

(54) DEVELOPMENT DEVICE AND IMAGE FORMING APPARATUS

(75) Inventor: Atsushi Ohta, Tokyo (JP)

(73) Assignee: Oki Data Corporation, Tokyo (JP)

( * ) Notice: Subject to any disclaimer, the term of this patent is extended or adjusted under 35 U.S.C. 154(b) by 229 days.

(21) Appl. No.: 12/471,862

(22) Filed: May 26, 2009

(65) Prior Publication Data

US 2009/0324284 A1 Dec. 31, 2009

(30) Foreign Application Priority Data

Jun. 27, 2008 (JP) ..... 2008-169458

(51) Int. Cl.
*G03G 15/08* (2006.01)

(52) U.S. Cl. ..... 399/120; 399/358; 399/359; 399/360

(58) Field of Classification Search ..... 399/120, 399/358–360
See application file for complete search history.

(56) References Cited

U.S. PATENT DOCUMENTS

2006/0002750 A1* 1/2006 Ono ..... 399/359
2008/0166162 A1* 7/2008 Hayashi et al. ..... 399/359

FOREIGN PATENT DOCUMENTS

JP 09-269639 A 10/1997
JP 2002-006711 A 1/2002
JP 2004-240137 A 8/2004
JP 2005-292366 A 10/2005

* cited by examiner

*Primary Examiner* — Ryan Walsh
(74) *Attorney, Agent, or Firm* — Panitch Schwarze Belisario & Nadel LLP

(57) ABSTRACT

A development device includes a plurality of development units and a waste substance container or containers storing the waste substance removed by the cleaning member. Each of the plural development units includes an image carrier carrying a developer image formed by developer and a cleaning member cleaning the image carrier by removing a waste substance. A number of the waste substance containers disposed is smaller than a number of development units disposed, and the number of the waste substance containers is greater than or equal to one.

20 Claims, 13 Drawing Sheets

DEVELOPMENT DEVICE AND IMAGE FORMING APPARATUS

BACKGROUND OF THE INVENTION

1. Field of the Invention

The present invention relates to a development device and an image forming apparatus such as a photocopier, a printer, and a facsimile machine with a multicolor electrophotographic method.

2. Description of Related Art

In a conventional image forming apparatus having a plurality of development devices with a multicolor electrophotographic method, a toner is transferred to a transfer medium in the course of image formation while a toner not transferred to the transfer medium is collected as a waste toner by a cleaning device. The waste toner collected by the cleaning device is mixed of different colors of toners. Consequently, the collected toner is discarded without subjecting to recycling.

Generally, a conventional image forming apparatus includes a waste toner container storing a waste toner therein. For example, in a case where the conventional image forming apparatus employs a method using a transfer belt or an intermediate transfer belt in a transfer device, a toner adhered to a surface of such a belt is collected as the waste toner in the waste toner container, causing not only an increase in an amount to the toner to be discarded, but also an increase in difficulty of dealing with such a toner.

For example, Japanese Un-examined Patent Application Publication No. 2005-292366 discloses a waste toner container disposed separately from a supply toner container in each of toner cartridges detachably disposed with respect to development units corresponding to respective toner colors so as to reduce the above difficulty. Particularly, a size of each of the toner cartridges is increased, and the development units are disposed to have space therebetween, so that the waste toner expelled from the development unit is stored in the waste toner container disposed separately from the supply toner container in each of the toner cartridges.

BRIEF SUMMARY OF THE INVENTION

According to one aspect of the invention, a development device includes: a plurality of development units, each of the plural development units including an image carrier carrying a developer image formed by developer, and a cleaning member cleaning the image carrier by removing a waste substance; and a waste substance container or waste substance containers storing the waste substance removed by the cleaning member. A number of the waste substance containers disposed is smaller than a number of development units disposed, and the number of the waste substance containers is greater than or equal to one.

According to another aspect of the invention, a development device includes: a plurality of development units, each of the plural development units including an image carrier carrying a developer image formed by developer, and a cleaning member cleaning the image carrier by removing a waste substance; a conveyance member conveying the waste substance removed by each of the plural cleaning members; a waste substance container storing the waste substance conveyed by the conveyance member; and a rotation drive member allowing an end portion of the conveyance member to rotate.

According to another aspect of the invention, an image forming apparatus includes: a plurality of development units, each of the plural development units including an image carrier carrying a developer image formed by developer, a transfer medium transferring the developer image thereon, and a cleaning member disposed on a downstream side relative to a contact point between the image carrier and the transfer medium in a rotation direction of the image carrier to clean the image carrier by removing a waste substance; a conveyance member conveying the waste substance removed by each of the plural cleaning members; and a waste substance container disposed to one of the developer units disposed on the most upstream side in a conveyance direction of the transfer medium to store the waste substance conveyed by the conveyance member.

Accordingly, the present invention provides a development device and an image forming apparatus capable of reducing a size of the image forming apparatus as a whole by reducing space between each of the development units.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
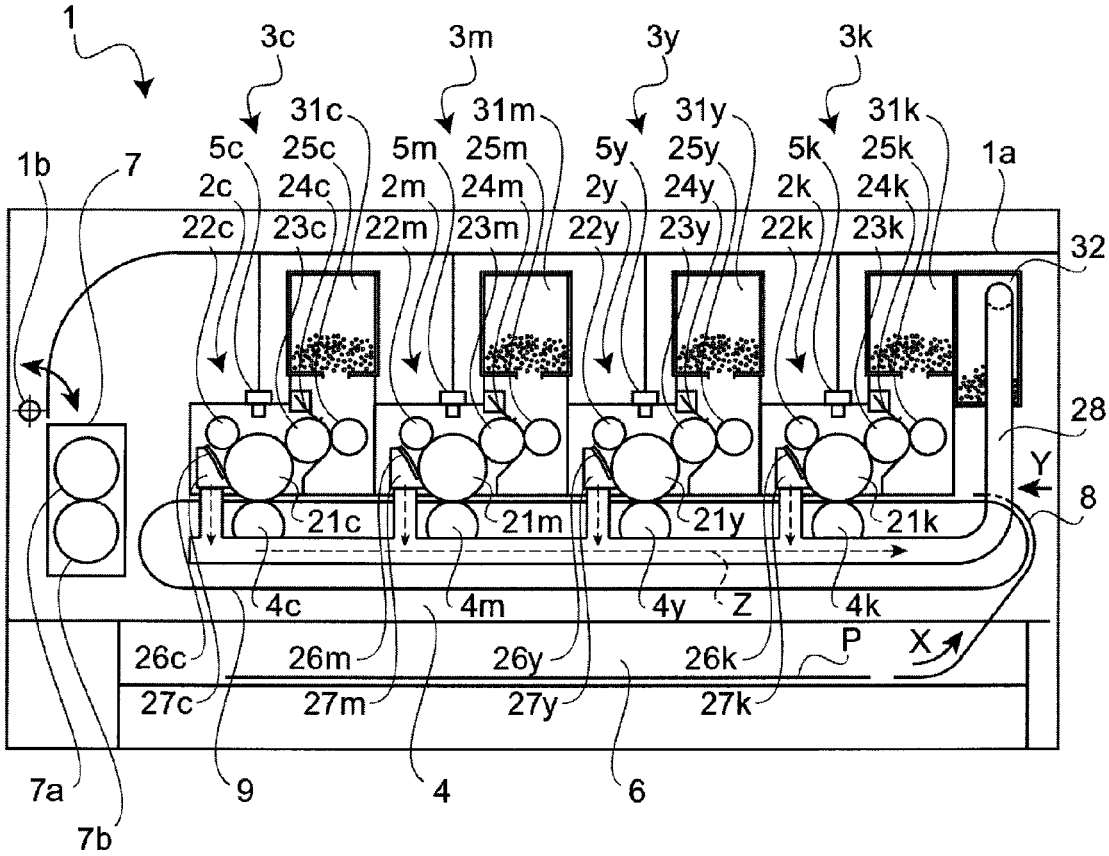
FIG. 1 is a schematic diagram illustrating a printer serving as an image forming apparatus according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, like reference numerals designate identical or corresponding parts throughout the several views.

First Embodiment

Referring to FIG. 1, a printer 1 serving as an image forming apparatus according to a first embodiment of the present invention is illustrated. The printer 1 includes: development units 2*k*, 2*y*, 2*m*, and 2*c* corresponding to toners of black, yellow, magenta, and cyan, respectively (hereafter, the toner colors of black, yellow, magenta, and cyan are abbreviated as k, y, m, and c, respectively); toner cartridges 3*k*, 3*y*, 3*m*, and 3*c* serving as developer containers storing respective colors of the toner serving as developer; a transfer unit 4 transferring toner images developed on photosensitive drum 21*k*, 21*y*, 21*m*, and 21*c* (described later) to a sheet P serving as a transfer medium; exposure units 5*k*, 5*y*, 5*m*, and 5*c* forming electrostatic latent images on surfaces of the photosensitive drums 21*k*, 21*y*, 21*m*, and 21*c* with irradiation of light; a sheet feeding cassette 6 storing the sheet P therein and feeding the sheet P in a direction indicated by an arrow "X" shown in FIG. 1; a fixing unit 7 fixing the toner images transferred by the transfer unit 4 to the sheet P; and a sheet conveyance path 8, in a substantially "S" shape, disposed with respect to a lower frame of the printer 1.

The development units 2*k*, 2*y*, 2*m*, and 2*c* are sequentially disposed along the sheet conveyance path 8 from a sheet feeding side to an ejection side of the sheet P in a direction indicated by "Y" shown in FIG. 1. The development units 2*k*, 2*y*, 2*m*, and 2*c* are integrally formed as a development device 2 and are detachably disposed with respect to the printer 1. According to the first embodiment of the present invention, only the development unit 2*k* includes a waste toner container 32 (described later) annexed to a toner cartridge 3*k* as illustrated in FIG. 1. Since each of the development units 2*k*, 2*y*, 2*m*, and 2*c* is substantially similar to one another except for the color of the toner and the waste substance container 32, the one development unit 2*k* is described as representative of all the development units 2*k*, 2*y*, 2*m*, and 2*c* while descriptions of the development units 2*y*, 2*m*, and 2*c* are omitted for the sake of simplicity.

The development unit 2*k* includes: the photosensitive drum 21*k* serving as an image carrier; a charging roller 22*k* uniformly charging the surface of the photosensitive drum 21*k*; a development roller 23*k* supplying the toner to the photosensitive drum 21*k*; a development blade 24*k* regulating a layer thickness of the toner supplied to the development roller 23*k*; a supply roller 25*k* supplying the toner to the development roller 23*k*; a cleaning blade 26*k* serving as a cleaning member removing a residual toner not transferred to the sheet P and remained on the photosensitive drum 21*k*; and a first conveyance member 27*k* serving as a conveyance member conveying the residual toner removed by the cleaning blade 26*k* as a waste toner.

The photosensitive drum 21*k*, serving as an organic photosensitive member, includes a conductive support member and a photoconductive layer. In the photosensitive drum 21*k*, a charge generation layer and a charge transport layer serving as the photoconductive layers are sequentially laminated on a metal pipe, for example, made of aluminum, serving as the conductive support member. The surface of the photosensitive drum 21*k* is uniformly charged by the charging roller 22*k*, and forms the electrostatic latent image thereon with the light irradiated by the exposure unit 5.

The charging roller 22*k* includes a metal shaft and a semi-conductive rubber layer, for example, made of epichlorohydrin rubber. The charging roller 22*k* contacts the photosensitive drum 21*k* with a prescribed pressure amount, and is rotatably driven by rotation of the photosensitive drum 21*k*. The charging roller 22*k* is connected with a charging roller power source (not shown) applying the bias voltage of the same polarity as the toner, so that the surface of the photosensitive drum 21*k* is uniformly charged by the bias voltage applied by the charging roller power source.

The development roller 23*k* includes a metal shaft and a semi-conductive urethane rubber layer. The development roller 23*k* contacts the photosensitive drum 21*k* with a prescribed pressure amount and supplies the toner to the electrostatic latent image formed on the photosensitive drum 21*k*, thereby reversely developing the image. The development roller 23*k* is connected with a development roller power source (not shown) applying the bias voltage of the same polarity as the toner or the reverse polarity to the toner, so that the toner charged by the bias voltage applied from the development roller power source is adhered to the electrostatic latent image on the photosensitive drum 21*k*.

The development blade 24*k* has, for example, a thickness of 0.08 mm and a length which is substantially the same as a longitudinal direction length of the development roller 22*k*. The development blade 24*k* serves as a metal thin plate member regulating the layer thickness of the toner. One end of the development blade 24*k* in a longitudinal direction is secured to a frame (not shown), and another end is disposed in such a manner as to contact the development roller 23*k* with a slight portion of an inner surface in a leading end thereof.

The supply roller 25*k* includes a metal shaft and a semi-conductive foam silicone sponge layer. The supply roller 25 *k* contacts the development roller 23*k* with a prescribed pressure amount and supplies the toner to the development roller 23*k*. The supply roller 25*k* is connected with a supply roller power source (not shown) applying the bias voltage of the same polarity as the toner or the reverse polarity to the toner, so that the toner supplied from a supply toner container 31*k* serving as a developer container included in the toner cartridge 3*k* is supplied to the development roller 23*k* by the bias voltage applied from the supply roller power source.

The cleaning blade 26*k* serves as a rubber member made of urethane and is disposed in a position in which one end thereof contacts the photosensitive drum 21*k* with a prescribed pressure amount. A longitudinal direction length of the cleaning blade 26*k* is substantially the same as that of the photosensitive drum 21*k*. The cleaning blade 26*k* scrapes the residual toner from the surface of the photosensitive drum 21*k*, so that the surface of the photosensitive drum 21*k* is cleaned. The surface of the photosensitive drum 21*k* has a small quantity of a substance adhered thereto from the transfer belt 9 (described later), and the cleaning blade 26*k* scrapes such an adhesion substance from the surface of the photosensitive drum 21*k*.

The first conveyance member 27*k* conveys the residual toner and the adhesion substance removed by the cleaning blade 26*k* towards a front side in a rotation direction of the photosensitive drum 21*k* in FIG. 1. Herein, the residual toner and the adhesion substance are conveyed as the waste toner. The first conveyance member 27*k* is connected to a second conveyance member 28 serving as a conveyance member forming a conveyance path of the waste toner. The waste toner conveyed by the first conveyance member 27*k* is conveyed by the second conveyance member 28 to the waste toner container 32 serving as the waste substance container (described later). The second conveyance member 28 collectively conveys the waste toner conveyed from the first conveyance members 27*k*, 27*y*, 27*m*, and 27*c* included in respective development units 2*k*, 2*k*, 2*m*, and 2*c* to a direction indicated by an arrow "Z" shown in FIG. 1. The first and second conveyance members 27 and 28 serving as the conveyance members are described in detail later.

The toner cartridges 3*k*, 3*y*, 3*m*, and 3*c* respectively include the supply toner containers 31*k*, 31*y*, 31*m*, and 31*c* each of which is a hollow structure. The supply toner containers 31*k*, 31*y*, 31*m*, and 31*c* store unused toners of black, yellow, magenta, and cyan, respectively. Among such toner cartridges 3*k*, 3*y*, 3*m*, an 3*c*, the toner cartridge 3*k* positioned on the most upstream side of the sheet conveyance path 8 has the waste toner container 32 annexed to the supply toner container 31*k*. The waste toner container 32, having independent storage space adjacent to the supply toner container 31*k*, stores the waste toner conveyed by the second conveyance member 28.

Each of the development device 2, the toner cartridges 3*k*, 3*y*, 3*m*, and 3*c*, and the like is a replaceable unit in the printer 1. Therefore, in a case where the toner is consumed, or in a case where a component is deteriorated, such a replaceable unit can be replaced.

The transfer unit 4 includes: the transfer belt 9 conveying the sheet P with electrostatic absorption of the sheet P thereto; a drive roller (not shown) driving the transfer belt 9 by being rotated by a drive unit (not shown); a tension roller (not shown) forming a pair with the drive roller to tightly stretch the transfer belt 9; and the transfer rollers 4, 4*y*, 4*m*, and 4*c*, disposed opposite to the respective photosensitive drums 21*k*, 21*y*, 21*m*, and 21*c* with pressure, applying the voltage in such a manner as to transfer the toner images to the sheet P. Each of the transfer rollers 4*k*, 4*y*, 4*m*, and 4*c* is connected with a transfer roller power source (not shown) applying the bias voltage of the reverse polarity to the toner, so that the toner images formed on the respective photosensitive drums 21*k*, 21*y*, 21*m*, and 21*c* are transferred to the sheet P by the bias voltage applied from the transfer roller power source.

Each of the exposure units 5*k*, 5*y*, 5*m*, and 5*c* serves as a light emitting diode (LED) head having a light emitting element such as LED and a lens array, for example. The exposure units 5*k*, 5*y*, 5*m*, and 5*c* irradiate the surfaces of the respective photosensitive drums 21*k*, 21*y*, 21*m*, and 21*c* with the light based on print data input, so that the potential of each of irradiated areas decays, thereby forming the electrostatic latent images on the surfaces of the photosensitive drums 21*k*, 21*y*, 21*m*, and 21*c*.

The sheet feeding cassette 6 stores the sheet P therein in a state that a plurality of sheets P are stacked. The sheet feeding cassette 6 is detachably attached in a lower portion of the printer 1. A sheet feeding unit (not shown) is disposed above the sheet feeding cassette 6, and includes a hopping roller feeding the sheet P sheet by sheet. The sheet P is fed in the direction "X" shown in FIG. 1 by the sheet feeding unit and is conveyed to the development device 2 by a conveyance roller (not shown).

The fixing unit 7 is disposed on a downstream side of the sheet conveyance path 8 and includes a heat roller 7*a*, a pressure roller 7*b*, a thermistor (not shown), and a heater (not shown). The heat roller 7*a*, for example, includes a hollow cylindrical core metal made of aluminum, a heat-resistant elastic layer made of silicone rubber, and a tube made of tetrafluoroethylene-perfluoroalkyl vinyl ether copolymer (PFA). The metal core is coated with the heat-resistant elastic layer, and such an elastic layer is coated with the PFA tube. The metal core includes, for example, a heater such as a halogen lamp therein. The pressure roller 7*b* includes, for example, a core metal made of aluminum, a heat-resistant elastic layer made of silicone rubber coating the core metal therewith, and a PFA tube coating the heat-resistant elastic layer therewith. The pressure roller 7*b* is disposed in such a manner as to form a pressure portion between the pressure roller 7*b* and the heat roller 7*a*. The thermistor serves as a temperature detection member detecting the surface temperature of the pressure roller 7*a* and is disposed in the vicinity of the heat roller 7*a* in a non-contact manner. The heater is controlled based on a result of the surface temperature of the heat roller 7*a* detected by the thermistor, so that the surface temperature of the heat roller 7*a* is maintained at prescribed temperature. The toner image transferred to the sheet P passes the pressure portion formed between the pressure roller 7*b* and the heat roller 7*a* maintained at the prescribed temperature, so that the toner image is fixed on the sheet P by application of the heat and pressure.

Moreover, the printer 1 includes: a print data input unit, for example, receiving an input of print data from an external device; a display unit including a display device such as a liquid crystal display (LCD) to display a state of the printer 1; an operation unit including an input member such as a touch panel to receive a print instruction input from a user; and a central processing unit (CPU) controlling the operation of the printer 1.

According to the printer 1, the toner image formed by the development device 2 can be transferred to and fixed on the sheet P, and the image based on the print data input can be output to an external unit. Among the toner cartridges 3*k*, 3*y*, 3*m*, an 3*c* storing the toner of respective colors, the toner cartridge 3*k* positioned on the most upstream side of the sheet conveyance path 8 has the waste toner container 32 annexed to the supply toner container 31*k*. Since the waste toner container 32 has the independent storage space adjacent to the supply toner container 31*k*, an adequate amount of the black toner (k) to be used for the development can be stored in the supply toner container 31*k*. Moreover, since the waste toner container 32 is annexed to only the toner cartridge 3*k*, space between each of the development units can be reduced, thereby allowing a size of the printer 1 as a whole to be reduced or allowing a storage amount of the supply toner to be increased. Moreover, the waste toner container 32 is annexed to the toner cartridge 3*k* storing the most frequently used toner of black among other colors (i.e., yellow, magenta, and cyan), thereby reducing an occurrence of a toner cartridge replacement in a case where an unused toner of less frequently used colors such yellow, magenta, or cyan is remained in the supply toner container 31*y*, 31*m*, or 31*c*, respectively.

Moreover, since the toner cartridge 3*k* is disposed on the most upstream side in the conveyance direction of the sheet P, the toner cartridge 3*k* tends not to be influenced by radiant heat from the fixing unit 7.

Moreover, a top cover 1*a* of the printer 1 includes the exposure units 5*k*, 5*y*, 5*m*, and 5*c* disposed toward respective development units 2*k*, 2*y*, 2*m*, and 2*c*, and is provided with a rotation support member 1*b* rotatably mounted with respect to the printer 1. The rotation support member 1*b* is disposed on the side near the fixing unit 7, and the user can open the top cover 1*a* to have access to inside the printer 1, for example, in a case of replacement of the toner cartridges 3. The waste toner container 32 is disposed in a farthest position from the rotation support member 1*b* of the top cover 1*a*. That is, the waste toner container 32 is disposed to the toner cartridge 3*k* disposed farthest from the rotation support member 1*b*, so that the space between each of the development units can be easily reduced, thereby allowing the size of the printer 1 to be reduced or allowing the storage amount of the supply toner to be increased. In other words, the waste toner container 32 is disposed outside the movement range of the exposure units 5, that is, outside the rotation radius of the exposure units 5, so that the space between each of the development units can be easily reduced, thereby reducing the size of the printer 1 and increasing the storage amount of the supply toner.

Figure 2:
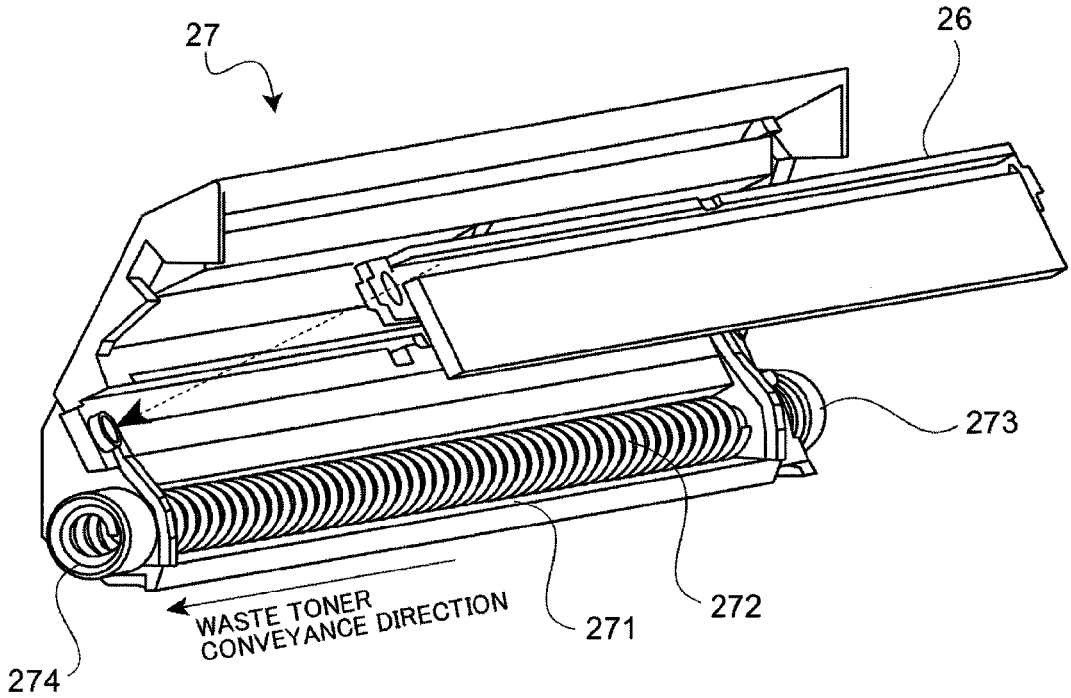
FIG. 2 is a schematic diagram illustrating a first conveyance member according to the first embodiment of the present invention.

Referring to FIG. 2, a description is given of conveyance of the waste toner to the waste toner container 32 by the first conveyance members 27*k*, 27*y*, 27*m*, and 27*c*. Since each of the first conveyance members 27*k*, 27*y*, 27*m*, and 27*c* is substantially similar to one another except for the toner color, a description of the first conveyance members 27*k*, 27*y*, 27*m*, and 27*c* is given by using a first conveyance member 27 as representative of the conveyance members 27*k*, 27*y*, 27*m*, and 27*c*. A description of the cleaning blades 26*k*, 26*y*, 26*m*, and 26*c* scraping and cleaning the residual toner on the respective photosensitive drums 21*k*, 21*y*, 21*m*, and 21*c* is given by using a cleaning blade 26 as representative of the cleaning blades 26*k*, 26*y*, 26*m*, and 26*c*.

As illustrated in FIG. 2, the first conveyance member 27 includes: a conveyance path 271 serving as a path in which the waste toner is conveyed; a conveyance spiral coil 272 conveying the waste toner along the conveyance path 271; a drive transmission gear 273 transmitting driving force from a drive source (not shown) to the conveyance spiral coil 272; and a first waste toner outlet 274 expelling the waste toner conveyed along the conveyance path 271 therefrom.

The conveyance path 271 is disposed in a position in which the toner scraped from the photosensitive drum 21 by the cleaning blade 26 is dropped and accumulated, and a longitudinal direction length of the conveyance path 271 is arranged in such a manner as to be substantially the same as that of the cleaning blade 26. The spiral coil 272 is rotated at a certain circumferential speed in a prescribed rotation direction by the driving force transmitted through the drive transmission gear 273 disposed on an upstream side in a waste toner conveyance direction of the conveyance path 271. The waste toner is conveyed in the waste toner conveyance direction with the rotation of the conveyance spiral coil 272. The waste toner conveyed by the rotation of the conveyance spiral coil 272 is expelled from the first waste toner outlet 274 disposed on a downstream side in the waste toner conveyance direction of the conveyance path 271.

Figure 3:
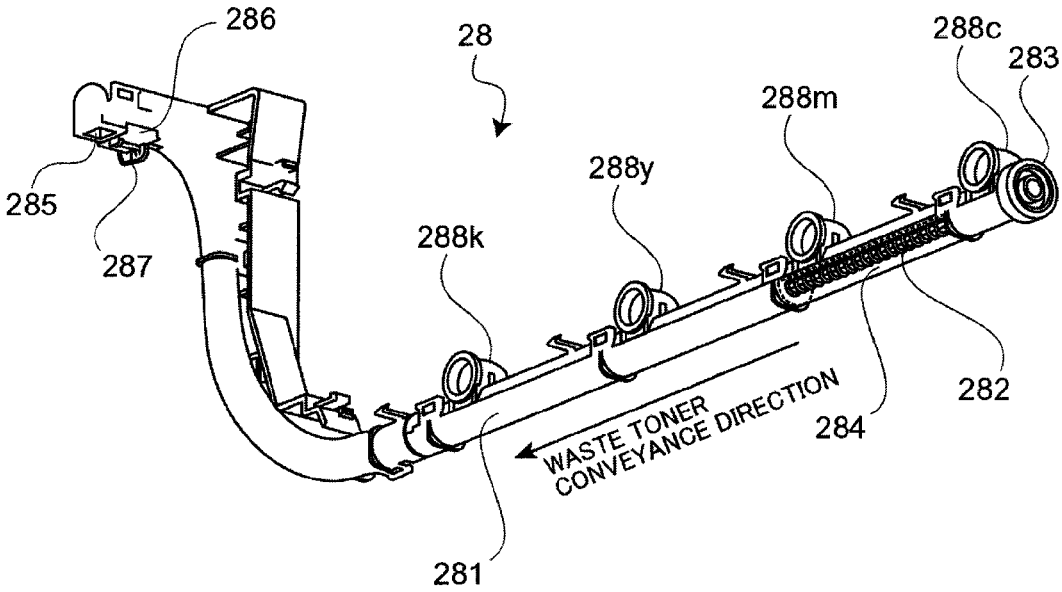
FIG. 3 is a schematic diagram illustrating a second conveyance member according to the first embodiment of the present invention.

Referring to FIG. 3, the second conveyance member 28 is illustrated in a schematic diagram. The second conveyance member 28 includes: a conveyance path 281 serving as a path in which the waste toner is conveyed; a conveyance flat spiral 282 conveying the waste toner along the conveyance path 281; a drive transmission gear 283 transmitting driving force from a drive power source (not shown) to the conveyance flat spiral 282; a spiral deformation prevention bar 284 preventing the conveyance flat spiral 282 from deformation; a second waste toner outlet 285 expelling the waste toner conveyed along the conveyance path 281; a waste toner outlet open-close shutter 286 controlling opening and closing of the second waste toner outlet 285; an urging spring 287 urging the waste toner outlet open-close shutter 286 in a prescribed direction; and first waste toner inlets 288*k*, 288*y*, 288*m*, and 288*c* flowing therein the waste toner expelled from the first waste toner outlet 274. Herein, the conveyance flat spiral 282, for example, represents a spiral formed by a wire rod having a flat surface.

The conveyance path 281 is formed of a cylindrical pipe member and has a flexion portion having an adequate curvature in a prescribed location. The conveyance flat spiral 282 serves as a spiral coil in a shape of a rectangular cross section, and has a length substantially the same as the longitudinal direction length of the conveyance path 281. The conveyance flat spiral 282 is disposed inside the conveyance path 281. The drive transmission gear 283 allowing the conveyance flat spiral 282 to drive is disposed in an end portion on an upstream side in the waste toner conveyance direction of the conveyance path 281, and obtains the driving force through a drive source (not shown) of the development device 2, for example, an orthogonal axis transmission gear such as a bevel gear. The spiral deformation prevention bar 284 is disposed in an area inside the conveyance flat spiral 282 corresponding a straight portion of the conveyance path 281. The spiral deformation prevention bar 284 prevents the conveyance flat spiral 282 from a damage caused by distortion or twist of a certain level or above in a case where the conveyance flat spiral 282 is deformed in a compression direction by resistance of the waste toner to be discarded or friction between the conveyance flat spiral 282 and a conveyance path wall surface. The second waste toner outlet 285 is disposed downward in an end portion on a downstream side in the waste toner conveyance direction of the conveyance path 281, and the waste toner outlet open-close shutter 286 is urged by the urging spring 287 in a closing direction of the second waste toner outlet 285. In the straight portion of the conveyance path 281, each of the first waste toner inlets 288*k*, 288*y*, 288*m*, and 288*c* is disposed in a position one level above within a prescribed area, and the first waste toner inlets 288*k*, 288*y*, 288*m*, and 288*c* are coupled to the first waste toner outlets 274*k*, 274*y*, 274*m*, and 274*c*, respectively, so that the waste toner expelled from the first waste toner outlets 274*k*, 274*y*, 274*m*, and 274*k* are flown into the second conveyance member 28.

Figure 4:
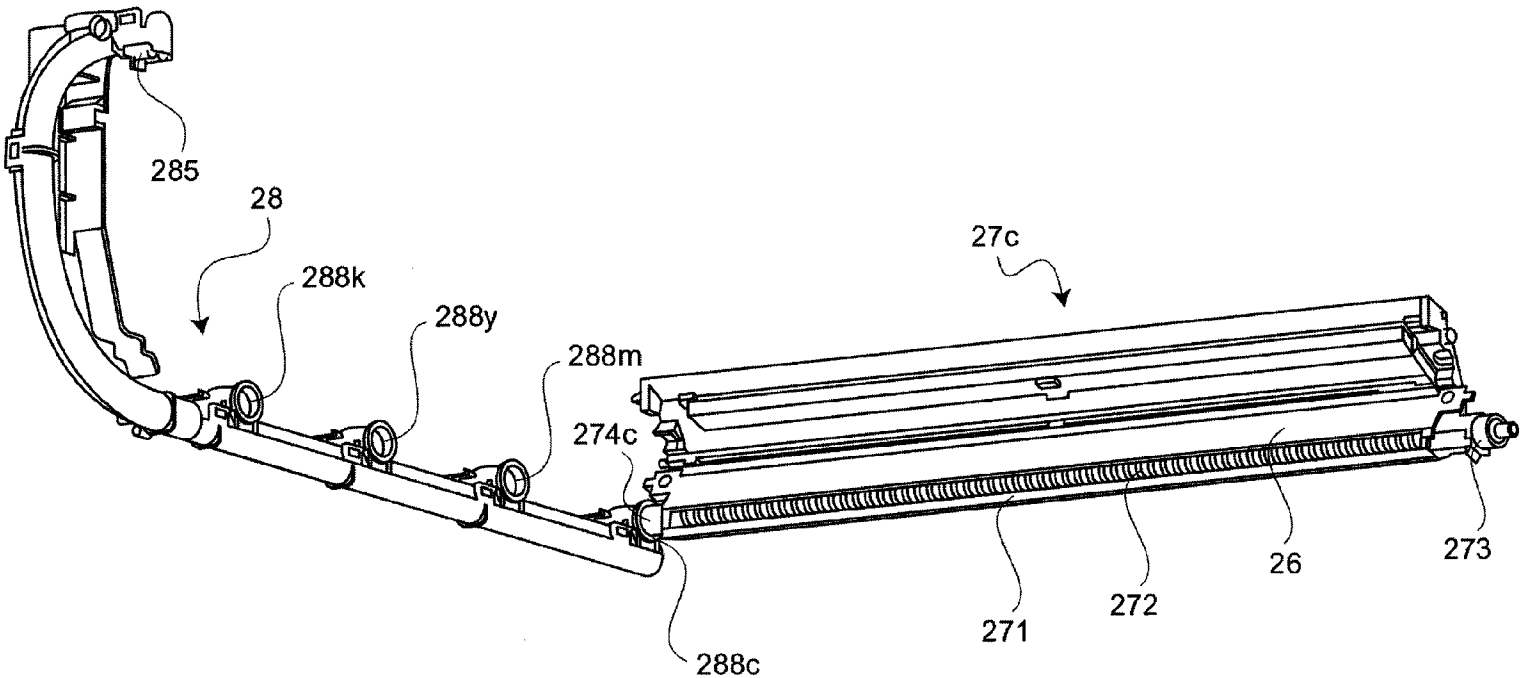
FIG. 4 is a schematic diagram illustrating a coupling state of the first conveyance member and the second conveyance member.

Referring to FIG. 4, the first conveyance member 27*c* and the second conveyance member 28 in a coupling state is illustrated in a schematic diagram. Since the first conveyance members 27*k*, 27*y*, 27*m*, and 27*c* are substantially similar to one another except for the toner color, a description of the first conveyance members 27*k*, 27*y*, 27*m*, and 27*c* is given by using the first conveyance member 27*c* for the development unit 2*c* as representative of the conveyance members 27*k*, 27*y*, 27*m*, and 27*c*. As illustrated in FIG. 4, the first waste toner inlet 288*c* of the second conveyance member 28 is connected to the first waste toner outlet 274*c* of the first conveyance member 27*c*. In this way, the second conveyance member 28 is coupled in such a manner as to be positioned one level below with respect to the first conveyance member 27*c*, so that the waste toner expelled from the first conveyance member 27 is dropped inside the conveyance path 281 of the second conveyance member 28 by a weight thereof.

Figure 5:
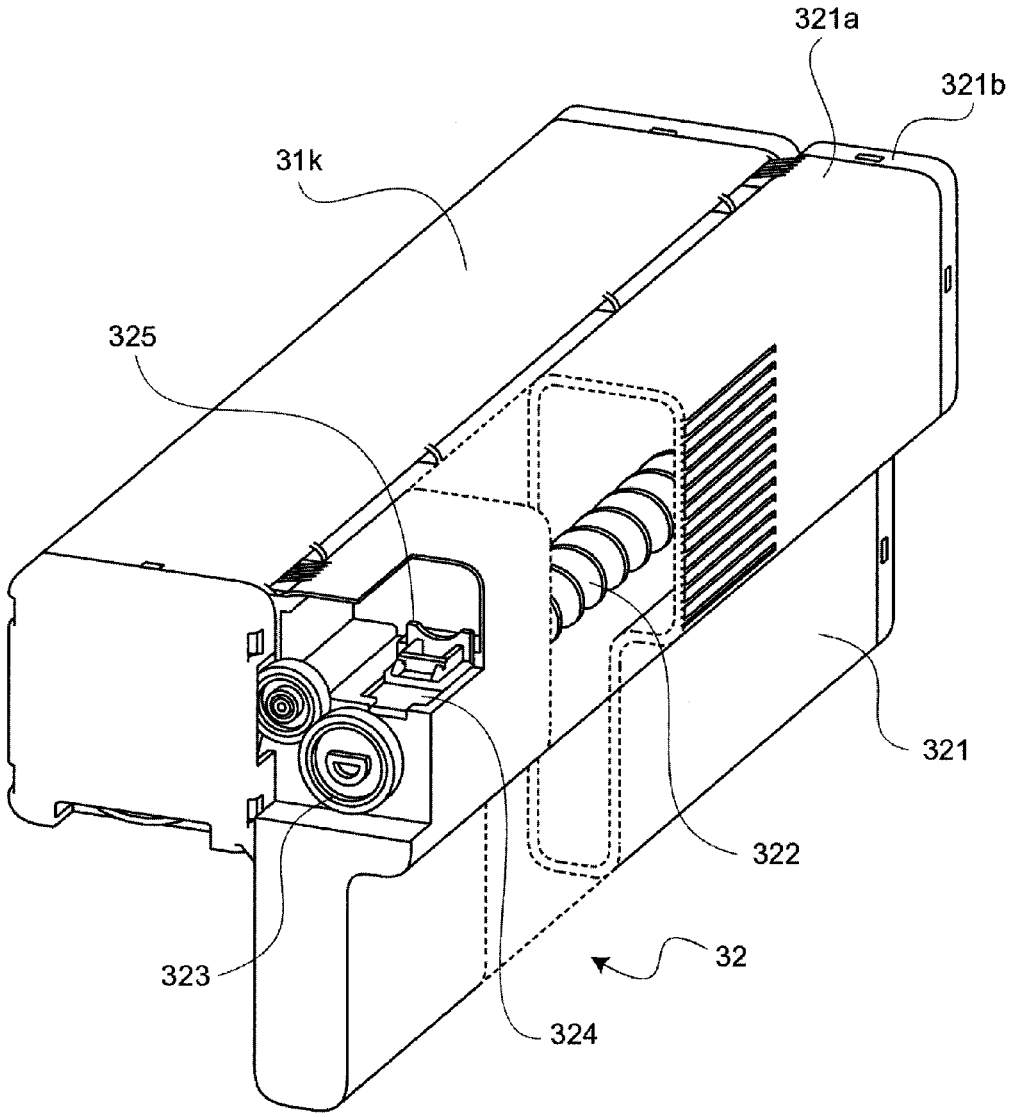
FIG. 5 is a schematic diagram illustrating a waste toner container according to the first embodiment of the present invention.

Referring to FIG. 5, the waste toner container 32 is illustrated in a schematic diagram. The waste toner container 32 includes: a frame 321; a toner conveyance spiral 322 conveying the waste toner in an inner direction of the storage space; a drive transmission gear 323 transmitting driving force from a drive source (not shown) to the toner conveyance spiral 322; a waste toner collection inlet 324 flowing therein the waste toner expelled form the second waste toner outlet 285; and a waste toner collection inlet open-close shutter 325 controlling opening and closing of the waste toner collection inlet 324.

The frame 321 includes a body frame 321*a* and a side plate 321*b*, and has a waste toner storage space independent from the supply toner container 31*k* therein. The frame 321 may be integrally formed with respect to a frame of the supply toner container 31*k*, or may be integrally attached to the frame of the supply toner container 31*k* by a latch engagement, for example. The toner conveyance spiral 322 is rotated at a certain circumferential speed in a prescribed rotation direction by the driving force transmitted through the drive transmission gear 323. The accumulated waste toner is conveyed in the inner direction of the storage space with the rotation of the toner conveyance spiral 322. The waste toner collection inlet open-close shutter 325 is urged by an urging spring (not shown) in a closing direction of the waste toner collection inlet 324.

Figure 6:
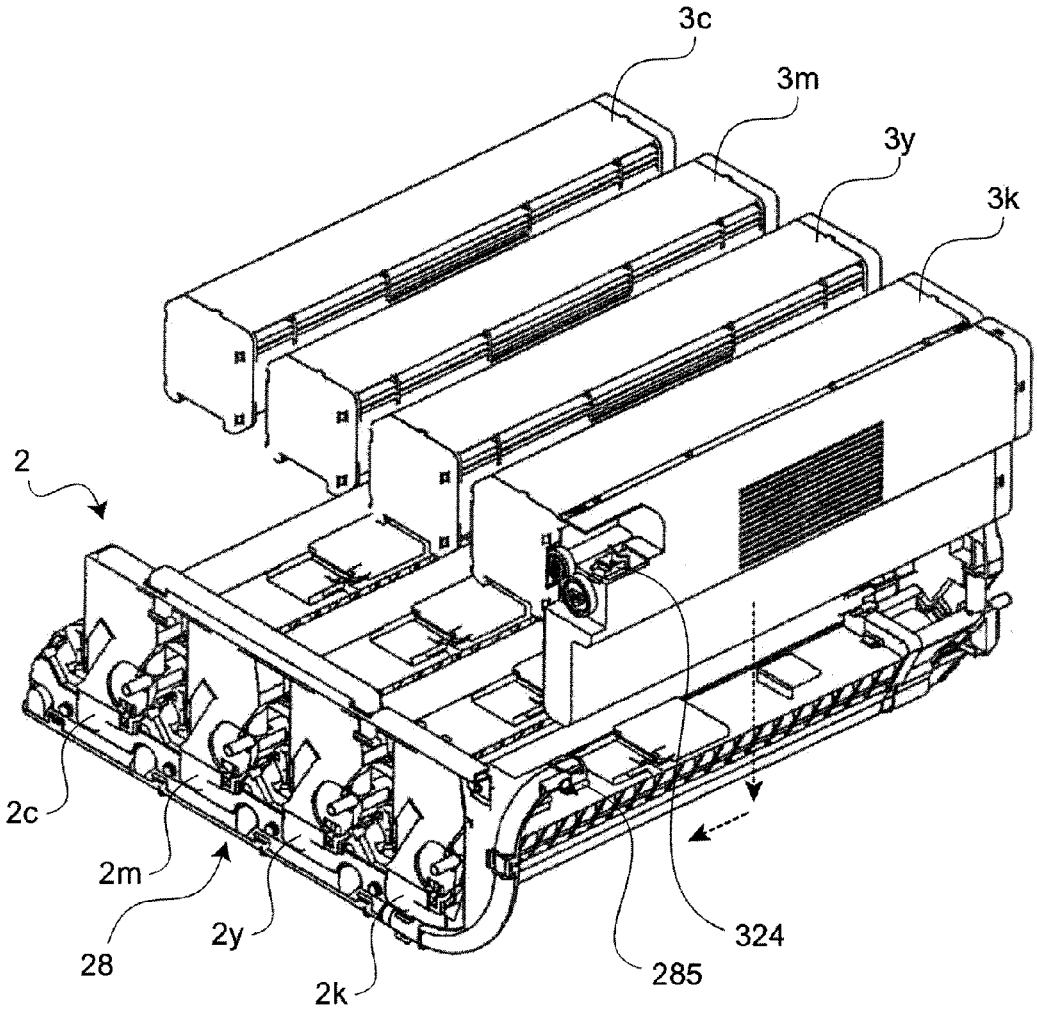
FIG. 6 is a schematic diagram illustrating operation in a case where each of toner cartridges is connected to the second conveyance member attached to a development unit.
Figure 7:
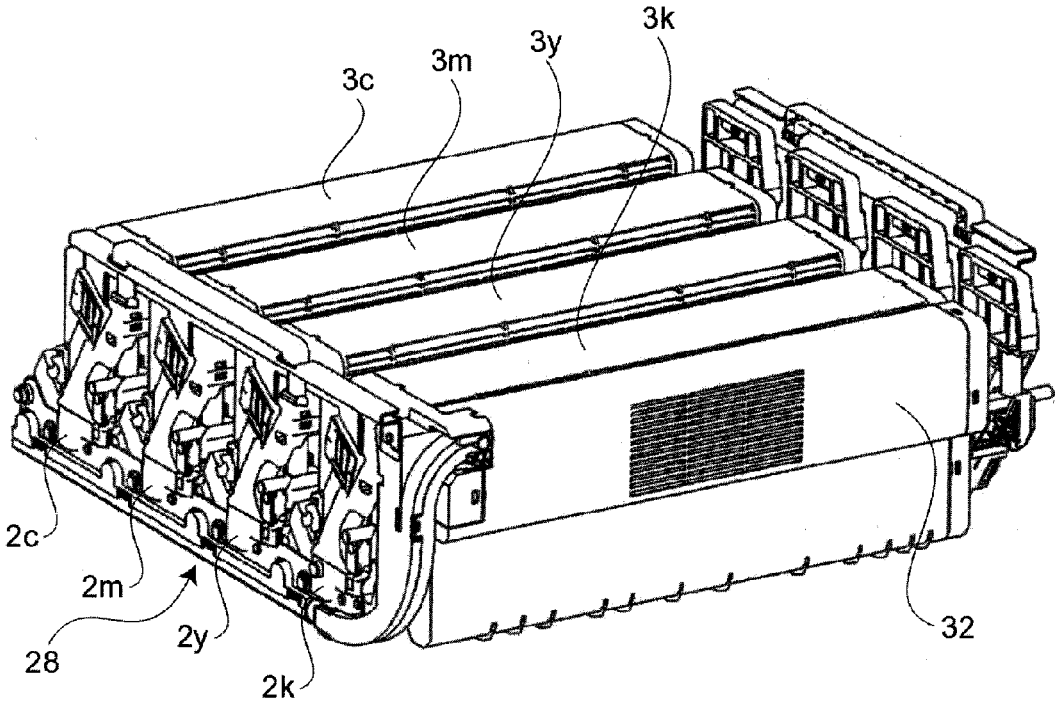
FIG. 7 is a schematic diagram illustrating an attachment state of the toner cartridge and the second conveyance member attached to the development unit.

Referring to FIGS. 6 and 7, a description is given of operation in a case where each of the toner cartridges 3*k*, 3*y*, 3*m*, and 3*c* is connected to the second conveyance member 28 attached to the development units 2*k*, 2*y*, 2*m*, and 2*c*, and a description is given of a state that the toner cartridges 3*k*, 3*y*, 3*m*, and 3*c* are connected to the respective development units 2*k*, 2*y*, 2*m*, and 2*k*, respectively.

As illustrated in FIG. 6, in a case where each of the toner cartridges 3*k*, 3*y*, 3*m*, and 3*c* is connected to the second conveyance member 28 attached to the development units 2*k*, 2*y*, 2*m*, and 2*c*, the toner cartridges 3*k*, 3*y*, 3*m*, and 3*c* corresponding to the respective development units 2*k*, 2*y*, 2*m*, and 2*c* are moved in directions indicated by arrows shown in FIG. 6, and the waste toner outlet 285 of the second conveyance member 28 and the waste toner collection inlet 324 of the toner cartridge 3*k* are attached such a manner as to be engaged. Consequently, the toner cartridges 3*k*, 3*y*, 3*m*, and 3*c* and the second conveyance member 28 attached to the development units 2*k*, 2*y*, 2*m*, and 2*c* are attached as illustrated in FIG. 7.

Figure 8:
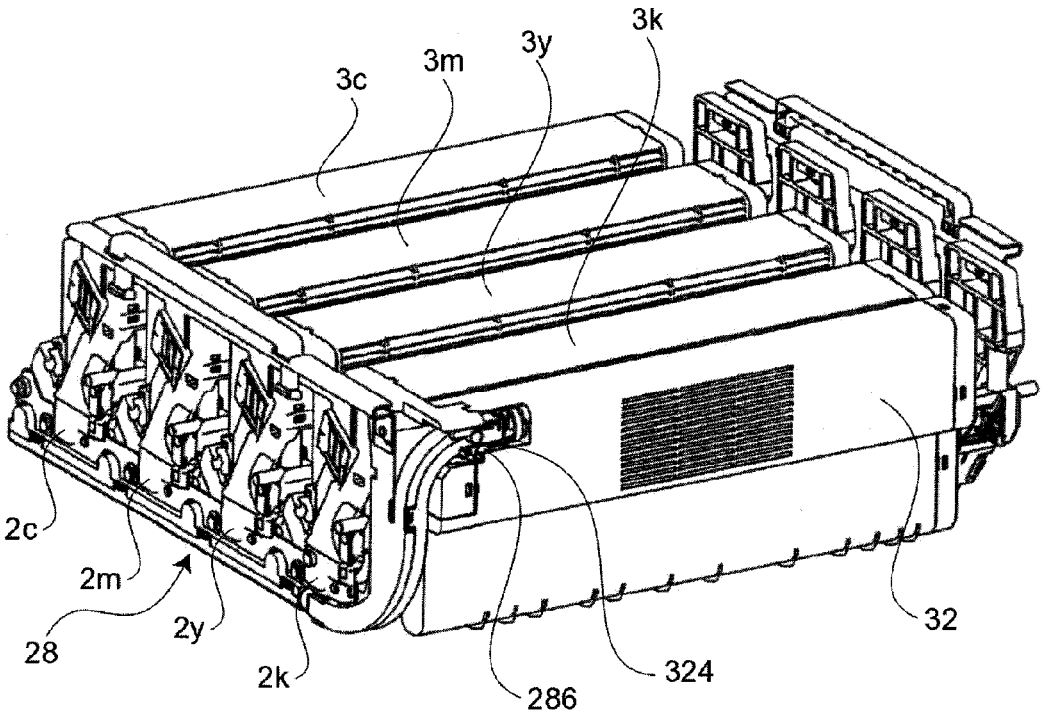
FIG. 8 is a schematic diagram illustrating a joint portion between a waste toner outlet of the second conveyance member and a waste toner collection inlet of the toner cartridge as seen when the toner cartridge is partially cut.

Referring to FIG. 8, the toner cartridge 3*k* is partially cut to illustrate a joint portion between the waste toner outlet 285 of the second conveyance member 28 and the waste toner collection inlet 324 of the toner cartridge 3*k*. A vicinity of the waste toner collection inlet 324 of FIG. 8 is illustrated in an enlarged partial view of FIG. 9.

Figure 9:
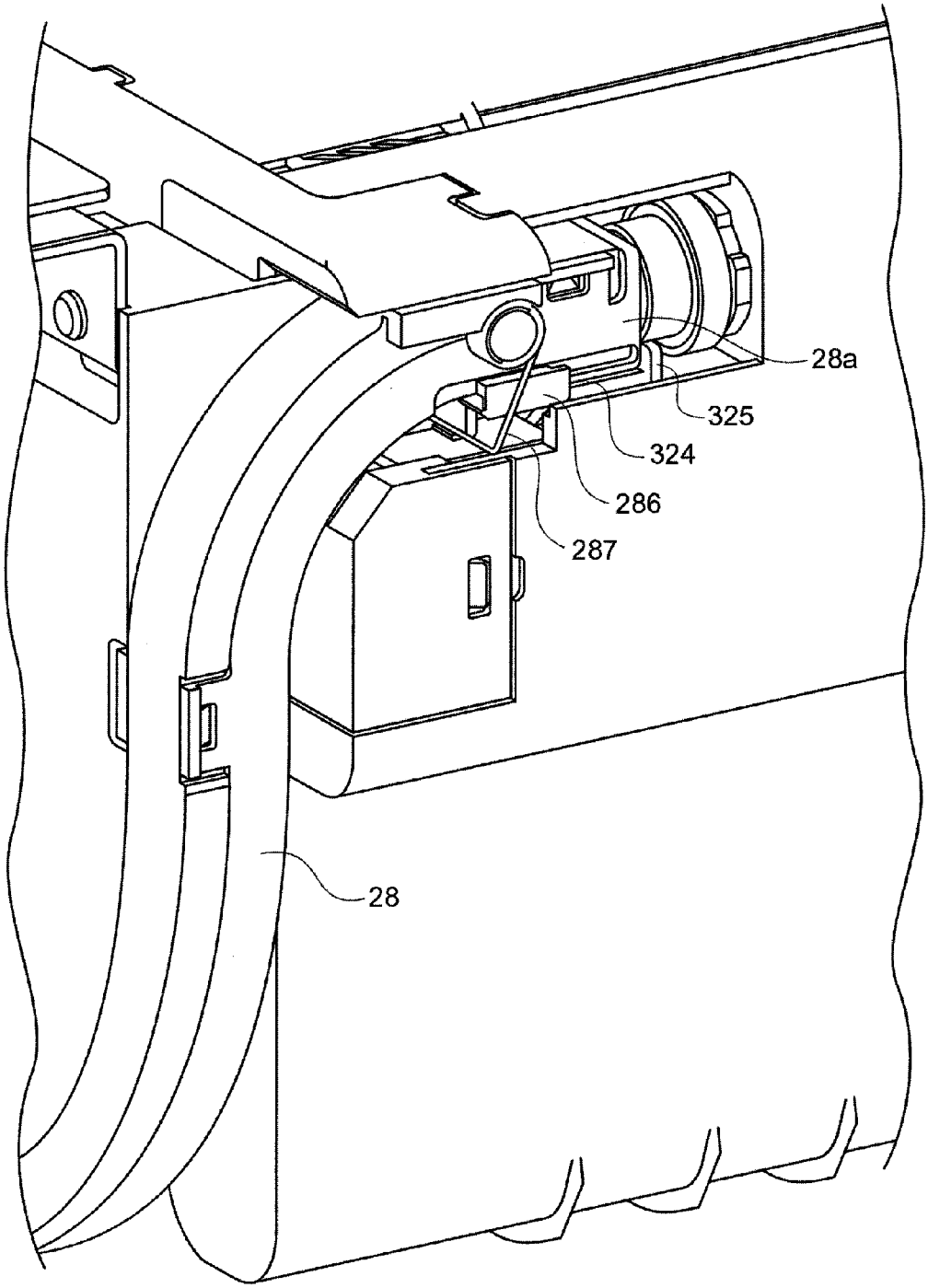
FIG. 9 is an enlarged partial view illustrating a vicinity of the waste toner collection inlet of the FIG. 8.

As illustrated in FIGS. 8 and 9, when the toner cartridge 3*k* is attached, an end portion 28*a* of the second conveyance member 28 having the waste toner outlet 285 pushes and moves the waste toner collection inlet open-close shutter 325 in an opening direction of the waste toner collection inlet 324. The waste toner outlet open-close shutter 286 moves in an opening direction of the waste toner outlet 285 with the movement of the waste toner collection inlet open-close shutter 325. As a result, both of the waste toner outlet 285 and the waste toner collection inlet 324 are open and placed one on another, so that the waste toner can be flown.

Now, a description is given of image forming operation of the printer 1. When the print data is input by the external device, and the image forming operation is begun, the surfaces of the photosensitive drums 21*k*, 21*y*, 21*m*, and 21*c* are discharged by a discharge device (not shown), and surface potentials of the photosensitive drums 21*k*, 21*y*, 21*m*, and 21*c* are averaged between 0 (zero) and −150 V, for example. The charging rollers 22*k*, 22*y*, 22*m*, and 22*c* disposed in contact with the surfaces of the respective photosensitive drums 21*k*, 21*y*, 21*m*, and 21*c* uniformly charge the surfaces of the respective photosensitive drums 21*k*, 21*y*, 21*m*, and 21*c* to approximately −1100 V, for example.

The exposure units 5*k*, 5*y*, 5*m*, and 5*c* irradiate the surfaces of the respective photosensitive drums 21*k*, 21*y*, 21*m*, and 21*c* with the light based on the print data, and the potential of each of the irradiated areas is decayed to, for example, approximately 0 (zero) to −290 V, thereby forming the electrostatic latent images. When each of the electrostatic latent images reaches a position in contact with the development rollers 23*k*, 23*y*, 23*m*, and 23*c* by the rotation of the photosensitive drums 21*k*, 21*y*, 21*m*, and 21*c*, the development rollers 23*k*, 23*y*, 23*m*, and 23*c* applied with the bias voltage of, for example, approximately −800 V allow the toner to adhere to the electrostatic latent images, thereby forming the toner images.

Herein, the supply rollers 25*k*, 25*y*, 25*m*, and 25*c* are rotated while frictionally contacting the respective development rollers 23*k*, 23*y*, 23*m*, and 23*c* in the development device 2, so that each surface of the development rollers 23*k*, 23*y*, 23*m*, and 23*c* is supplied with a certain amount of the toner. The development blade 24*k*, 24*y*, 24*m*, and 24*c* regulate the layer thickness of the toner frictionally charged and supplied to the surfaces of the development rollers 23*k*, 23*y*, 23*m*, and 23*c*.

The tone images formed by adhesion of the toner to the electrostatic latent images on the photosensitive drums 21*k*, 21*y*, 21*m*, and 21*c* are transferred to the sheet P by the transfer unit 4 at a time at which the sheet P fed from the sheet feeding cassette 6 reaches the photosensitive drums 21*k*, 21*y*, 21*m*, and 21*c*. The toner image transferred to the sheet P is fixed in the fixing unit by application of the heat and pressure. The sheet P is ejected outside the printer 1 after passing the fixing unit 7.

The cleaning blades 26*k*, 26*y*, 26*m*, and 26*c* scrapes the residual toner remained on the surfaces of the photosensitive drums 21*k*, 21*y*, 21*m*, and 21*c* without being transferred to the sheet P in the course of transferring the toner images by the transfer units 4*k*, 4*y*, 4*m*, and 4*c* to the sheet P, and the toner adhered to the surfaces of the photosensitive drums 21*k*, 21*y*, 21*m*, and 21*c* by reversely transferring from the sheet P, or an adhesion substance such as sheet dust on the transfer belt 9. Such toner scraped by the cleaning blades 26*k*, 26*y*, 26*m*, and 26*c* is conveyed to and stored in the waste toner container 32 annexed to the toner cartridge 3*k* by first conveyance members 27*k*, 27*y*, 27*m*, and 27*c*, and the second conveyance member 28.

A description is now given of arrangement of the waste toner storage space of the waste toner container 32 according to the first embodiment of the present invention. Herein, transfer efficiency of the toner image transferred to the sheet P can be determined as a ratio between an amount of the toner adhered by the development rollers 23*k*, 23*y*, 23*m*, and 23*c* to the surfaces of the respective photosensitive drums 21*k*, 21*y*, 21*m*, and 21*c* and an amount of the toner remained on each of the photosensitive drums 21*k*, 21*y*, 21*m*, and 21*c* without being transferred to the sheet P. Such an amount of the toner remained on each of the photosensitive drums 21*k*, 21*y*, 21*m*, and 21*c* without being transferred to the sheet P is also referred to as a remaining toner amount. According to the first embodiment, however, the transfer efficiency of each of the development units 2*k*, 2*y*, 2*m*, and 2*c* is experientially arranged to be 90 percent. Moreover, reverse transfer efficiency of the toner transferred from the sheet P to each of the photosensitive drums 21*k*, 21*y*, 21*m*, and 21*c* can be determined as a ratio between an amount of the toner transferred from each of the photosensitive drums 21*k*, 21*y*, 21*m*, and 21*c* to the sheet P and an amount of the toner reversely transferred from the sheet P to each of the photosensitive drums 21$k$, 21$y$, 21$m$, and 21$c$. According to the first embodiment, however, the reverse transfer efficiency is arranged to sequentially decrease to 7 percent, 4 percent, and 1 percent, each time the sheet P passes the development units 2$k$, 2$y$, 2$m$, and 2$c$. For example, in a case where the toner transferred to the sheet P by the development unit of a first color is reversely transferred in a development unit of a second color, the reverse efficiency is 7 percent. The reverse efficiency of a second round in a development unit of a third color is 4 percent, and a third round in a development unit of a fourth color is 1 percent.

Based on the above arrangements, an amount of the waste toner (also referred to as a waste toner amount) with respect to each development unit is calculated. Since the development unit 2$k$ is disposed on the most upstream side in the conveyance direction of the sheet P, the toner transferred to the sheet P is not reversely transferred. Therefore, the waste toner amount in the development unit 2$k$ is substantially equal to the amount the toner remained on the photosensitive drum 21$k$ without being transferred. Since 10 percent of a toner usage amount is not transferred to the sheet P and remained on the photosensitive drum 21$k$, the remaining toner amount in the development unit 2$k$, that is, the waste toner amount in the development unit 2$k$, is expressed as 0.1 Xk (g), where the usage amount of the black toner is Xk (g).

The waste toner amount in the development unit 2$y$ is substantially equal to a sum of the amount of the toner remained on the photosensitive drum 21$y$ without being transferred to the sheet P and the amount of the black toner reversely transferred. Since 10 percent of the toner usage amount is not transferred to the sheet P and remained on the photosensitive drum 21$y$, the remaining toner amount in the development unit 2$y$ is expressed as 0.1 Xy (g), where the usage amount of the yellow toner is Xy (g). The amount of the black toner reversely transferred is expressed as follows:

"Black toner amount on the sheet $P$"×"reverse transfer efficiency"=0.9$Xk$×7%=0.063$Xk$(g)

Therefore, the waste toner amount in the development unit 2$y$ is expressed as (0.1 Xy+0.063 Xy) (g).

The waste toner amount in the development unit 2$m$ is substantially equal to a sum of the amount of the toner remained on the photosensitive drum 21$m$ without being transferred to the sheet P, the amount of the black toner reversely transferred, and an amount of the yellow toner reversely transferred. Since 10 percent of the toner usage amount is not transferred to the sheet P and remained on the photosensitive drum 21$m$, the remaining toner amount is expressed as 0.1 Xm (g), where the usage amount of the magenta toner is Xm (g). The amount of the black toner reversely transferred is expressed as follows:

"Black toner amount on the sheet $P$"×"reverse transfer efficiency"=(0.9−0.063)$Xk$×4% =0.033$Xk$ (g)

The amount of the yellow toner reversely transferred is expressed as follows:

"Yellow toner amount on the sheet $P$"×"reverse transfer efficiency"=0.9$Xy$×7%=0.063$Xy$ (g)

Therefore, the waste toner amount in the development unit 2$m$ is expressed as (0.1 Xm+0.033 Xk+0.063 Xy) (g).

The waste toner amount in the development unit 2$c$ is substantially equal to a sum of the amount of the toner remained on the photosensitive drum 21$c$ without being transferred to the sheet P, the amount of the black toner reversely transferred, the amount of the yellow toner reversely transferred, and the amount the magenta toner reversely transferred. Since 10 percent of the toner usage amount is not transferred to the sheet P and remained on the photosensitive drum 21$c$, the remaining toner amount is expressed as 0.1 Xc (g), where the usage amount of the cyan toner is Xc (g). The amount of the black toner reversely transferred is expressed as follows:

"Black toner amount on the sheet $P$"×"reverse transfer efficiency"=(0.9−0.063−033)$Xk$×1%=0.008$Xk$ (g)

The amount of the yellow toner reversely transferred is expressed as follows:

"Yellow toner amount on the sheet $P$"×"reverse transfer efficiency"=(0.9−0.063)$Xy$×4%=0.033$Xy$ (g)

The amount of the magenta toner reversely transferred is expressed as follows:

"Magenta toner amount on the sheet $P$"×"reverse transfer efficiency"=0.9$Xm$×7%=0.063$Xm$ (g)

Therefore, the waste toner amount in the development unit 2$c$ is expressed as (0.1 Xc+0.008 Xk+0.0033Xy+0.063Xm) (g)

Therefore, a total amount of the waste toner during a prescribed period is approximately calculated as follows:

Total waste toner amount=(0.204$Xk$+0.196$Xy$+0.163$Xm$+0.1$Xc$) (g)

In a normal usage situation, a usage rate of the black toner is generally higher than that of each of the yellow, magenta, and cyan toners, and the toner cartridge 3$k$ is expected to be more frequently replaced compared to the toner cartridges 3$y$, 3$m$, and 3$c$. Herein, assuming that the usage amount of three toner colors of yellow, magenta, and cyan is Xy=Ym=Xc=aXk (a<1) at a replacement cycle time at which the black toner cartridge 3$k$ has consumed Xk (g). In such a situation, a total waste toner amount is approximately calculated as follows:

Waste toner amount expelled form the development unit 2$k$=0.1 Xk (g)

Waste toner amount expelled form the development unit 2$y$=(0.1$a$+0.063)$Xk$ (g)

Waste toner amount expelled form the development unit 2$m$=(0.163$a$+0.033)$Xk$ (g)

Waste toner amount expelled form the development unit 2$c$=(0.196$a$+0.008)$Xk$ (g)

Therefore, the total waste toner amount is approximately calculated as (0.459a+0.204) Xk (g)

According to the approximate calculation above, the waste toner storage space of the waste toner container 32 may be arranged based on anticipation of a toner storage amount of (0.459+0.204)=0.66-fold (i.e., zero point sixty-sixfold) at a maximum with respect to an initial loading amount of the black toner. Herein, in consideration of the small quantity of the adhesion substance from the transfer belt 9 to the surface of the photosensitive drum 21$k$, the toner storage amount may be preferably arranged to be 0.7-fold (i.e., zero point seven-fold) with respect to the initial loading amount. Since an amount of the adhesion substance may vary depending on usage environment or condition, the toner storage amount may be arranged appropriately.

According to the first embodiment described above, for example, the toner cartridge 3$k$ as the replaceable unit of the frequently used black toner is integrally disposed to the waste toner container 32, so that the space between each of the development units is reduced. Moreover, a storage region for the supply toner can be adequately provided in limited space, and a size of the printer 1 as a whole can be reduced or the loading amount of the supply toner can be increased. According to the first embodiment, since the waste toner container 32 is disposed to only the toner cartridge 3*k* having a short replacement cycle, the printer 1 can be designed with reduction of a waste toner storage region to be provided as the waste toner container 32. Moreover, the waste toner container 32 is not disposed to the less frequently used toner cartridges 3*y*, 3*m*, or 3*c*, thereby not only reducing an occurrence of replacing the less frequently used toner cartridge in a case where the unused toner of less frequently used color such yellow, magenta, or cyan is remained therein, but also enhancing usage efficiency of the toner.

According to the first embodiment, the waste toner container 32 is disposed to the toner cartridge 3*k* disposed in a position on the most upstream side in the conveyance direction of the sheet P, so that the space between each color of the development devices 2 and the space between each color of the photosensitive drums 21 is reduced. Consequently, the same advantage may be expected by, for example, disposition of the waste toner container 32 to the toner cartridge disposed on the most downstream side in the conveyance direction of the sheet P. However, since components of the fixing unit 7 are disposed adjacent to the most downstream side with respect to the conveyance direction of the sheet P, not only space for disposition of the waste toner container 32 is small on the most downstream side in the conveyance direction of the sheet P, but also the heat generated by the fixing unit 7 is likely to influence on the waste toner stored in the waste toner container 32 in the vicinity of the fixing unit 7. Therefore, the waste toner container 32 is disposed to the toner cartridge 3*k* disposed in the position on the most upstream side in the conveyance direction of the sheet P according to the first embodiment.

According to the first embodiment, the waste toner container 32 is disposed to the toner cartridge 3*k* having the most frequently used toner of black. However, in a case where the usage of the black toner is significantly higher than that of the yellow, magenta, and cyan toner, or in a case where a collection destination of the waste toner needs to be divided, the collection destination may be divided into two, for example, a collection destination for the black toner and a collection destination for the three colors. Herein, a waste toner collection mechanism for the three colors may be independently provided from a waste toner collection mechanism for the black color.

Figure 10:
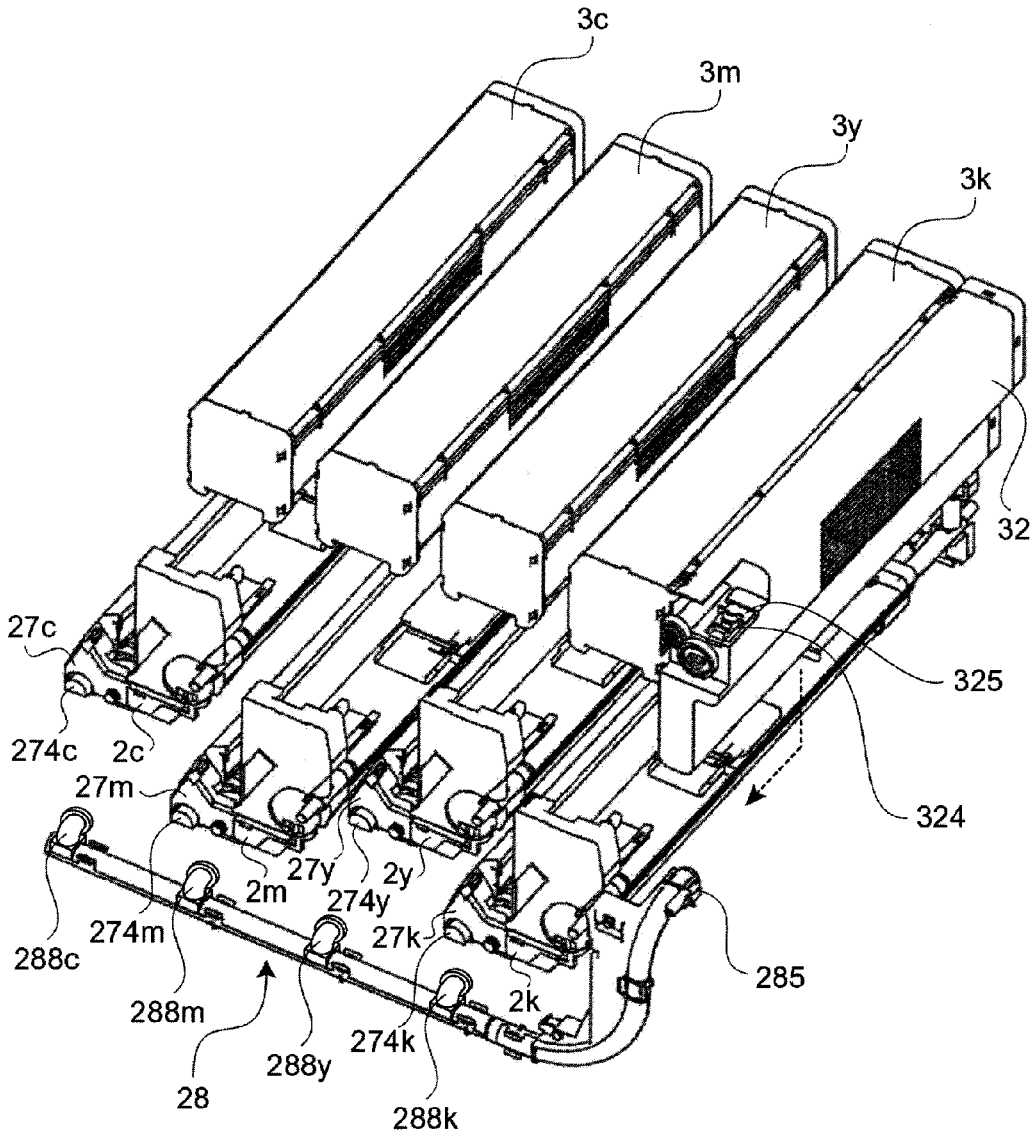
FIG. 10 is a schematic diagram illustrating a modification of the first embodiment of the present invention.

According to the first embodiment of the present invention, the second conveyance member 28 is included in the development 2. However, the present invention is not limited thereto. For example, the second conveyance member 28 may be included in a main body of the printer 1, and each of the development units 2*k*, 2*y*, 2*m*, and 2*c* may be disposed as an independent replaceable unit as illustrated in FIG. 10.

According to the first embodiment of the present invention, the first conveyance member 27 and the second conveyance member 28 respectively employ the coil spiral and the flat spiral as the conveyance member of the waste toner. The coil spiral may have a shape of round or square (i.e., horizon) in a cross section. According to the first embodiment, the spiral serving as the coil spiral has the round shape in the cross section. However, a spiral to be used may be varied depending on the waste toner amount or conveyance force.

Second Embodiment

A printer 100 and image forming operation according to a second embodiment are substantially similar to the printer 1 and image forming operation described above according to the first embodiment. Components and configurations of the printer 100 that differ from those of the above embodiment are described, and like components are given the same reference numerals as above and description thereof are omitted for the sake of simplicity.

Figure 11:
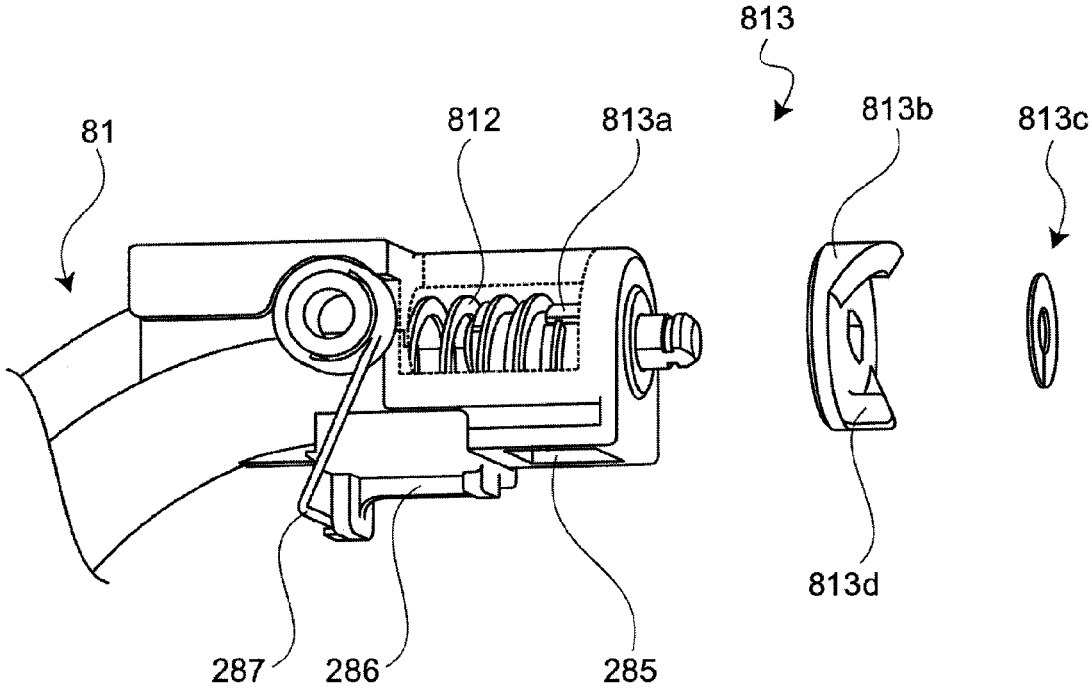
FIG. 11 is a partial schematic diagram illustrating a vicinity of a waste toner outlet in a second conveyance member according to a second embodiment of the present invention.

Referring to FIG. 11, a vicinity of a waste toner outlet 285 in a second conveyance member 81 is illustrated in a partial schematic diagram. The second conveyance member 81 includes: a conveyance flat spiral 812 conveying a waste toner; and a drive transmission member 813 (including the drive transmission members 813*a*, 813*b*, 813*c*) transmitting driving force from a drive member (described later) to the conveyance flat spiral 812. Herein, the conveyance flat spiral 812, for example, represents a spiral formed by a wire rod having a flat surface.

In the second conveyance member 81 according to the second embodiment, the drive transmission member 813 is disposed in the vicinity of the waste toner outlet 285 in an end portion on a downstream side in a waste toner conveyance direction unlike the second conveyance member 28 according to the above first embodiment having the drive transmission member disposed in an end portion on an upstream side in the waste toner conveyance direction.

The drive transmission member 813*a* includes on a cylindrical surface thereof a spiral rib and a rotation rib each of which has a pitch substantially the same as that of the conveyance flat spiral 812, and engages with the conveyance flat spiral 812. A leading end of the conveyance flat spiral 812 does not necessarily have a hook-shaped engagement portion. A side portion of the drive transmission member 813*b* has a rotation transmission protrusion 813*d* engaging with a waste toner collection portion (described later) on the side near the toner cartridge by coupling connection, thereby transmitting the driving force with respect to the drive transmission member 813*a* through an engagement portion such as D-cutting. The drive transmission member 813*c* serving as a fall prevention member made of a PET film, for example, is disposed such that the drive transmission member 813*b* does not fall from the drive transmission member 813*a*. One surface of the rotation transmission protrusion 813*d* is formed in a taper shape in such a manner as to rotate in a rotation direction while slidably contacting a rotation transmission protrusion 912*a* (described later) in a case where the rotation transmission protrusion 813*d* collides face to face with the rotation transmission protrusion 912*a* on the side near the toner cartridge in the course of attachment of the toner cartridge.

Figure 12:
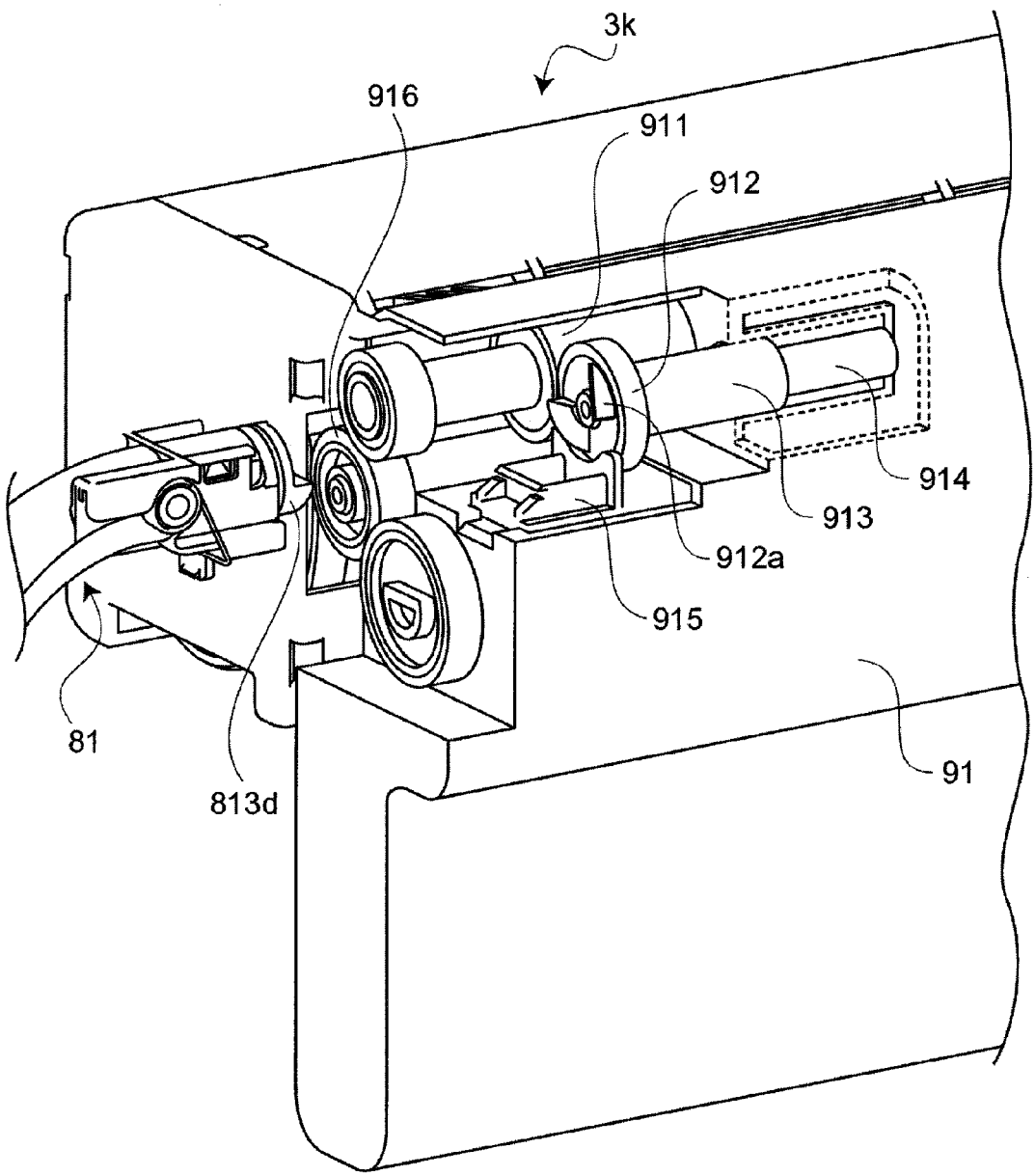
FIG. 12 is a partial schematic diagram illustrating a vicinity of a waste toner collection inlet of a waste toner container according to the second embodiment of the present invention.

Referring to FIG. 12, the vicinity of the waste toner collection inlet 324 of a waste toner container 91 is illustrated in a partial schematic diagram. The waste toner container 91 includes a drive member 916 driving the conveyance flat spiral 812 by connecting with the second conveyance member 81 in the vicinity of the waste toner collection inlet 324.

As illustrated in FIG. 12, the waste toner container 91 includes: a drive transmission idle gear 911 transmitting driving force from a driving source (not shown) to a drive transmission gear 912; the drive transmission gear 912 transmitting the driving force to the conveyance flat spiral 812 by engagement with the rotation transmission protrusion 813*d* of the second conveyance member 81; a slidable post 913 slidably disposed in a rotation axis direction of the drive transmission gear 912; an urging spring 914 urging the slidable post 913; and a waste toner collection inlet open-close shutter 915 controlling opening and closing of the waste toner collection inlet 324.

The drive transmission idle gear 911 is rotatably driven by the drive member 916 disposed adjacent thereto, and transmits the driving force to the drive transmission gear 912. The drive transmission idle gear 911 has a spur gear on a circumference surface thereof such that the drive transmission gear 912 is slidable with respect to the rotation axis direction thereof. The drive transmission gear 912 includes the rotation transmission protrusion 912*a* engaging with the rotation transmission protrusion 813*d* of the second conveyance member 81 on a side portion thereof. The drive transmission gear 912 is disposed in such a manner as to be rotatable about an axis of the slidable post 913 capable of sliding in the rotation axis direction by being urged by the urging spring 914. The drive transmission gear 912 is slidable in a range of a gear teeth width of the spur gear formed in the circumference surface of the drive transmission idle gear 911 disposed adjacent thereto and engaged therewith. The waste toner collection inlet open-close shutter 915 is urged in an opening direction of the waste toner collection inlet 324 through the drive transmission gear 912.

Figure 13:
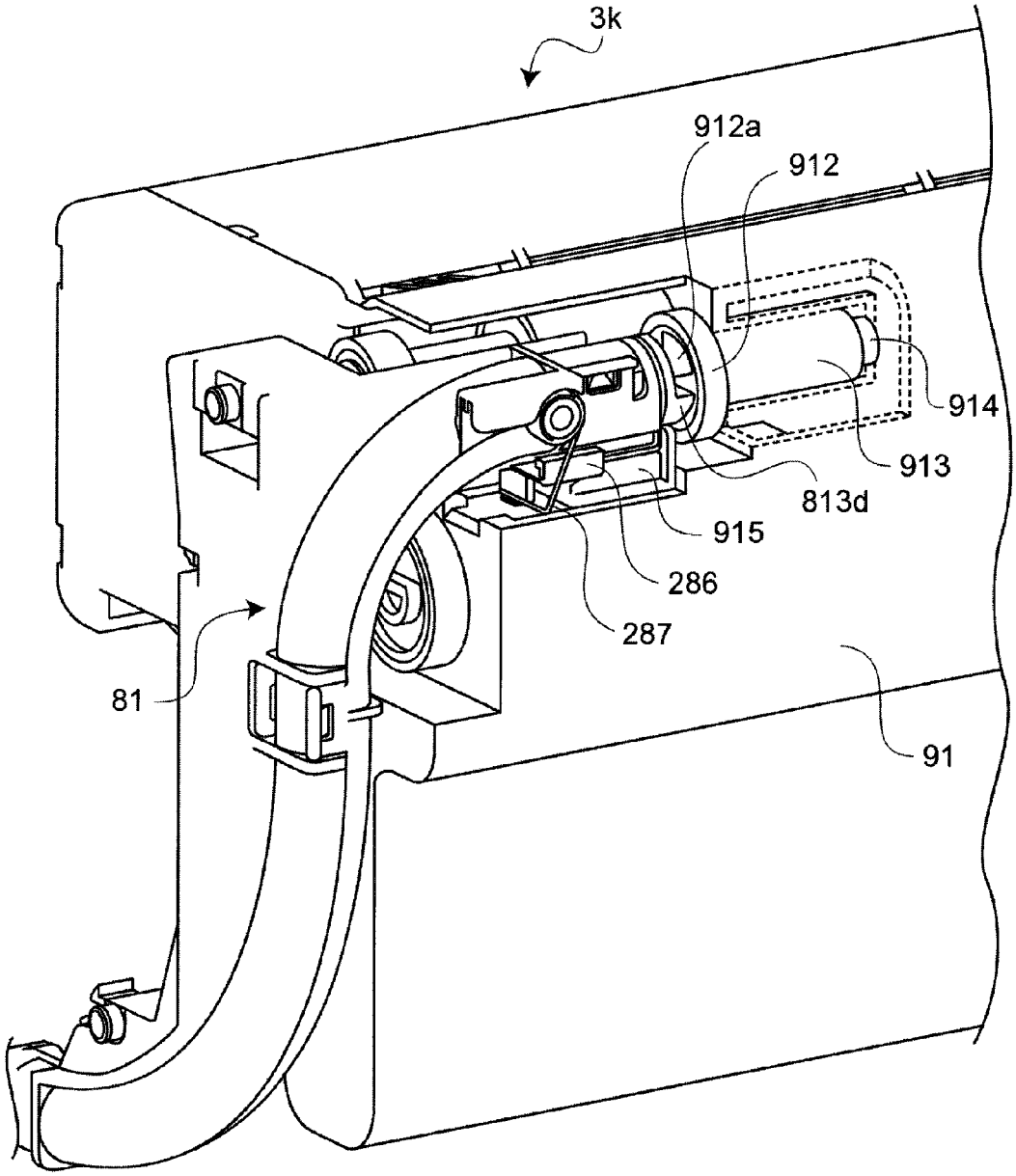
FIG. 13 is an enlarged partial view illustrating a joint portion between the waste toner outlet of the second conveyance member and the waste toner collection inlet of a toner cartridge as seen when the toner cartridge is partially cut.

Referring to FIG. 13, the toner cartridge 3*k* is partially cut to illustrate a joint portion of the waste toner outlet 285 of the second conveyance member 81 and the waste toner collection inlet 324 of the toner cartridge 3*k* in an enlarged partial view.

As illustrated in FIG. 13, in a case where the toner cartridge 3*k* is attached, the drive transmission member 813 of the second conveyance member 81 contacts the waste toner collection inlet open-close shutter 915 and the drive transmission gear 912 of the waste toner container 91 and continues to push and move the waste toner collection inlet open-close shutter 915 and the drive transmission gear 912 until the waste toner collection inlet 324 is open. The waste toner outlet open-close shutter 286 moves in an opening direction of the waste toner outlet 285 with the movement of the waste toner collection inlet open-close shutter 915. Consequently, both of the waste toner outlet 285 and the waste toner collection inlet 324 are open and placed one on another, so that the waste toner can be flown.

The conveyance flat spiral 812 included in the second conveyance member 81 is rotated at a certain circumferential speed in a prescribed rotation direction by the driving force transmitted through the drive transmission member 813, so that waste toner is conveyed to the waste toner outlet 285. Such waste toner is conveyed from the second conveyance member 81 to the waste toner container 91.

A description is now given of a driving method of the conveyance flat spiral 812. According to the second embodiment, the drive transmission member 813 transmitting the driving force to drive the conveyance flat spiral 812 is disposed in the vicinity of the waste toner outlet 285 in the end portion on the downstream side in the waste toner conveyance direction unlike the second conveyance member 28 according to the first embodiment having the drive transmission member disposed in the end portion on the upstream side in the waste toner conveyance direction. Herein, a difference between the driving method the conveyance flat spiral 282 according to the first embodiment and the driving method of the conveyance flat spiral 812 according to the second embodiment is described.

Figure 14A:
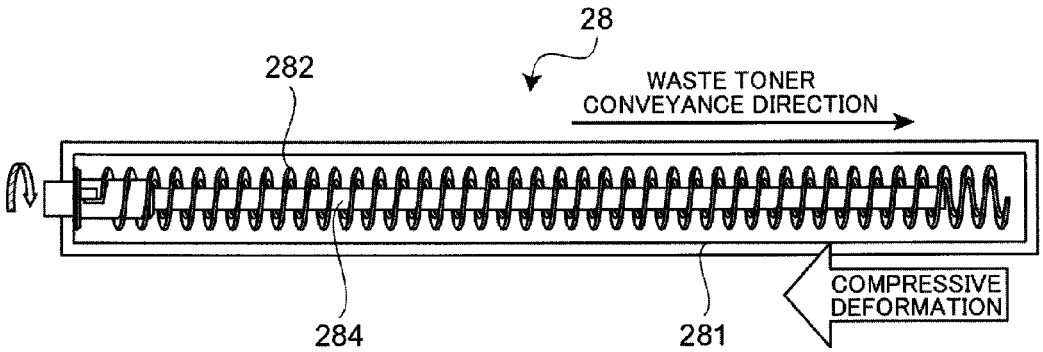
FIG. 14A is a schematic diagram illustrating a driving method of a conveyance flat spiral according to the first embodiment of the present invention.
Figure 14B:
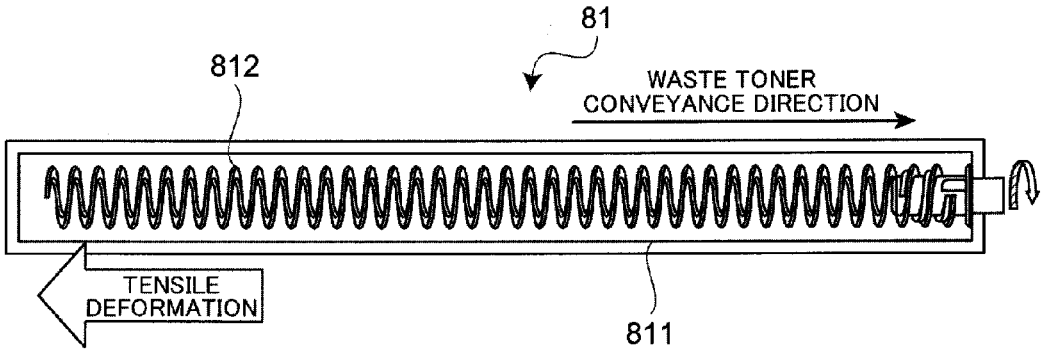
FIG. 14B is a schematic diagram illustrating a driving method of a conveyance flat spiral according to the second embodiment of the present invention.

The driving method of the conveyance flat spiral 282 according to the first embodiment is illustrated in FIG. 14A while the driving method of the conveyance flat spiral 812 according to the second embodiment is illustrated in FIG. 14B.

According to the driving method of the conveyance flat spiral 282 of the first embodiment as illustrated in FIG. 14A, in case where the conveyance flat spiral 282 is rotatably driven in the end portion on the upstream side in the waste toner conveyance direction, the conveyance flat spiral 282 is applied with resistance of the toner or friction between the conveyance flat spiral 282 and a wall surface of the conveyance path 281 towards the upstream side in the waste toner conveyance direction. Herein, in a case where a clearance between an inner diameter of the conveyance path 281 and an outer diameter of the conveyance flat spiral 282 is large, deformation of the conveyance flat spiral 282 in a compression direction causes the conveyance flat spiral 282 continuing to be forcefully rotated to twist gradually, resulting in an increase of risk of damaging the conveyance flat spiral 282.

Therefore, the spiral deformation prevention bar 284 needs to be disposed inside the conveyance flat spiral 282. Moreover, the conveyance flat spiral 282 is compressively deformed, causing an increase in the possibility of generating a gap from the downstream side in the waste toner conveyance direction of the conveyance flat spiral 282 to the waste toner outlet 285.

According to the driving method of the conveyance flat spiral 812 of the second embodiment as illustrated in FIG. 14B, on the other hand, in a case where the conveyance flat spiral 812 is rotatably driven in the end portion on the downstream side in the waste toner conveyance direction, the conveyance flat spiral 812 is applied with the resistance of the toner or the friction between the conveyance flat spiral 812 and a wall surface of the conveyance path 811 towards the upstream side in the waste toner conveyance direction. Herein, in a case where a clearance between the inner diameter of the conveyance path 811 and the outer diameter of the conveyance flat spiral 812 is large, the conveyance flat spiral 811 is deformed in a tensile direction, so that the conveyance flat spiral 812 continuing to be forcefully rotated is not twisted. Therefore, the spiral deformation prevention bar 284 of the first embodiment does not need to be disposed inside the conveyance flat spiral 812 of the second embodiment. Moreover, the tensile deformation of the conveyance flat spiral 812 is unlikely to generate the gap from the downstream side in the waste toner conveyance direction of the conveyance spiral 812 to the waste toner outlet 285. The conveyance flat spiral 812 according to the second embodiment can transmit the rotation in the waste toner direction without having a hook-shape portion at a leading end thereof.

That is, in a case where one end of the spiral is secured as considered to be a load applied in the course of conveying the waste toner while another end thereof is rotated, a spiral winding direction of the conveyance flat spiral 282 and the arrangement of the drive transmission member 813 of the conveyance flat spiral 282 are preferably determined in such a manner that an extension direction of the conveyance flat spiral 282 becomes the rotation direction thereof instead of rotating the conveyance flat spiral 282 in the compression direction. In other wards, in a case where the rotation direction of the drive transmission member 813 is secured in one direction, an arrangement of the spiral winding direction of the conveyance flat spiral 282 to be opposite to the spiral winding direction of the second embodiment allows the tensile deformation to be generated in a free end side although the drive transmission member 813 is disposed in the end portion on the upstream side in the waste toner conveyance direction, thereby providing substantially the same advantage as the second embodiment. According to the second embodiment, the drive transmission member 813 is disposed in the end portion on the downstream side in the waste toner conveyance direction, so that the waste toner is conveyed to the waste toner outlet 285 in a case where the amount of the waste toner in the conveyance path 281 is relatively small and the load is not generated in the rotation of the conveyance flat spiral 282. From such a standpoint, the disposition of the drive transmission member 813 in the end portion on the downstream side in the waste toner conveyance direction has an advantage over that in the end portion on the upstream side in the waste toner conveyance direction.

According to the second embodiment described above, the conveyance flat spiral 812 is rotatably driven on the downstream side in the waste toner direction, thereby reducing the twist occurrence of the conveyance flat spiral 812 in operation or the damage and the like caused by the twist in addition to the advantage of the first embodiment. Moreover, since the spiral deformation prevention bar 284 does not need to be disposed, the number of components can be reduced or a shape of the conveyance flat spiral 812 can be simplified.

The present invention has been described above with regard to particular embodiments, but the present invention is not limited thereto. For example, according to the first and second embodiments of the present invention described above, the respective printers 1 and 100 are described as the image forming apparatus. However, the present invention is not limited to thereto. The present invention may be applied to, for example, a photocopier, a facsimile machine, a multifunctional peripheral in addition to the printer. As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A development device comprising:

a plurality of development units, each of the plurality of development units including:

an image carrier carrying a developer image formed by developer;

a cleaning member cleaning the image carrier by removing a waste substance; and a first conveyance member for conveying waste substance removed by the cleaning member, wherein the plurality of development units are integrally, unitarily and monolithically formed as a single unit detachably disposed with respect to an image forming apparatus, a second conveyance member collectively conveying waste substance conveyed from the first conveyance member of each of the plurality of development units; and at least one waste substance container storing the waste substance conveyed from the second conveyance member, wherein, a number of the waste substance containers disposed is smaller than a number of development units disposed, the number of the waste substance containers being greater than or equal to one.

2. The development device according to claim 1, further comprising a plurality of developer containers, detachably disposed with respect to the plurality of development units, storing the developer therein, wherein the waste substance container is annexed to a prescribed developer container of the plurality of developer containers.

3. The development device according to claim 2, wherein the prescribed development container having the waste substance container is disposed to one of the plurality of development units having the highest consumption of the developer.

4. The development device according to claim 2, wherein the prescribed developer container having the waste substance container is disposed to at least one of the plurality of development units which develops a black image.

5. The development device according to claim 2, wherein the prescribed developer container having the waste substance container is disposed to one of the plurality of development units which is disposed on the most upstream side of a conveyance direction of a transfer medium.

6. The development device according to claim 5, wherein the prescribed developer container having the waste substance container includes a rotation drive member coupling with a rotation drive transmission member.

7. The development device according to claim 1, further comprising a conveyance member conveying the waste substance removed by each of the cleaning members, wherein the waste substance conveyed by the conveyance member is stored in the waste substance container.

8. The development device according to claim 7, wherein each of the first conveyance members includes a coil spiral.

9. The development device according to claim 8, wherein each coil spiral includes, in an end portion thereof on a downstream side in a conveyance direction of the waste substance, a rotation drive transmission member transmitting rotation driving force from a rotation drive member.

10. The development device according to claim 1, wherein the waste substance includes the developer.

11. The development device according to claim 1, wherein the waste substance container includes an opening that is opened upon attachment of a toner container.

12. The development device according to claim 11, wherein the waste substance container is arranged at a side of the toner container.

13. The development device according to claim 1, wherein the waste substance extends downwardly from the plurality of development units and includes spaced-apart ribs on an underside thereof.

14. A development device comprising:

a plurality of development units, each of the plurality of development units including:

an image carrier carrying a developer image formed by developer;

a cleaning member cleaning the image carrier by removing a waste substance; and a first conveyance member for conveying waste substance removed by the cleaning member, wherein the plurality of development units are integrally, unitarily and monolithically formed as a single unit detachably disposed with respect to an image forming apparatus, a second conveyance member collectively conveying waste substance conveyed from the first conveyance member of each of the plurality of development units;

a waste substance container storing the waste substance conveyed by the second conveyance member; and a rotation drive member allowing an end portion of the first conveyance member to rotate.

15. The development device according to claim 14, wherein the rotation drive member is disposed in an end portion on an upstream side in a conveyance direction of the waste substance.

16. The development device according to claim 14, wherein the rotation drive member is disposed in an end portion on a downstream side in a conveyance direction of the waste substance.

17. The development device according to claim 14, wherein each of the first conveyance members includes a coil spiral.

18. The development device according to claim 14, wherein the waste substance is a waste toner.

19. An image forming apparatus comprising:

a plurality of development units, each of the plurality of development units including:

an image carrier carrying a developer image formed by developer;

a transfer medium transferring the developer image thereon;

a cleaning member, disposed on a downstream side relative to a contact point between the image carrier and the transfer medium in a rotation direction of the image carrier, cleaning the image carrier by removing a waste substance; and a first conveyance member for conveying waste substance removed by the cleaning member, wherein the plurality of development units are integrally, unitarily and monolithically formed as a single unit detachably disposed with respect to the image forming apparatus, a second conveyance member collectively conveying waste substance conveyed from the first conveyance member of each of the plurality of development units; and a waste substance container, disposed to one of the developer units disposed on a most upstream side in a conveyance direction of the transfer medium, storing the waste substance conveyed by the second conveyance member.

20. The image forming apparatus according to claim 19, wherein the waste substance is a waste toner.

* * * * *